United States Patent [19]

Marker

[11] 3,940,156

[45] Feb. 24, 1976

[54] SAFETY SKI BINDING

[76] Inventor: Hannes Marker, Hauptstrasse 51-53, 81 Garmisch-Partenkirchen, Germany

[22] Filed: Sept. 24, 1974

[21] Appl. No.: 508,761

[52] U.S. Cl. ..... 280/11.35 R

[51] Int. Cl.[2] ..... A63C 9/08

[58] Field of Search 280/11.35 M, 11.35 K, 11.35 Y, 280/11.35 C, 11.35 A, 11.35 D, 11.35 E, 11.35 R

[56] References Cited

UNITED STATES PATENTS

| | | | |
|---|---|---|---|
| 3,292,941 | 12/1966 | Berchtold et al. | 280/11.35 T |
| 3,367,672 | 2/1968 | Tonozzi et al. | 280/11.35 M |
| 3,410,568 | 11/1968 | Wiley | 280/11.35 K |
| 3,667,769 | 6/1972 | Wunder | 280/11.35 C |
| 3,762,735 | 10/1973 | Smolka | 280/11.35 M |

FOREIGN PATENTS OR APPLICATIONS

| | | | |
|---|---|---|---|
| 2,014,935 | 10/1971 | Germany | 280/11.35 M |

*Primary Examiner*—M. Henson Wood, Jr.
*Assistant Examiner*—Milton L. Smith
*Attorney, Agent, or Firm*—Fleit & Jacobson

[57] ABSTRACT

In a safety ski binding for the automatic release of a ski boot from a ski in a case of danger, a releasable boot-holding member is secured by locking means comprising two interacting locking members. At least one of the locking members is carried by a supporting member so as to be displaceable within limits in the releasing direction of said boot-holding member.

2 Claims, 4 Drawing Figures

SAFETY SKI BINDING

The invention relates to a safety ski binding, i.e. an apparatus for the automatic release of a ski boot from a ski in a case of danger. More particularly, the invention concerns an improvement in or modification of the apparatus disclosed in prior U.S. patent application Ser. No. 396,723, filed Sept. 13, 1973.

The parent application relates, inter alia, to an apparatus for the automatic release, in a case of danger, of a ski boot held on a ski, comprising at least one boot-holding member, locking means for securing said boot-holding member, a threshold value switch influencing said locking means, a time-evaluating member, and a force receiver.

By means of this apparatus, the ski boot is held substantially rigidly to the ski during normal skiing. This is desirable, for example, in order to avoid unfavorable friction influences. On the other hand, it makes it necessary to give the mechanically stressed components a particularly strong construction, which has its disadvantages as far as manufacturing costs and weight are concerned. Another disadvantage of a substantially rigid connection between the ski and the boot is that slow or bad skiers or those not thoroughly trained experience discomfort because the rigid connection puts a greater strain on their legs and leads to fairly rapid fatigue.

The present invention therefore aims to achieve a compromise solution.

According to the invention, the aforementioned locking means comprise two interacting locking members of which at least one is carried by a supporting member so as to be resiliently displaceable within limits in the releasing direction of the said boot-holding member.

In a practical embodiment of the invention, it has been found desirable that the said supporting member carrying the resiliently displaceable locking member should be mounted on the ski. This also enables existing safety ski bindings according to the parent application to be simply and cheaply adapted in accordance with the present invention.

Preferably, the displacement of the said one locking member is variable. It is then possible for the skier to adapt the binding to any particular requirements or wishes with due regard to his skiing skill and the snow conditions.

An example of the invention will now be described with reference to the accompanying diagrammatic drawings in which.

Figure 1:
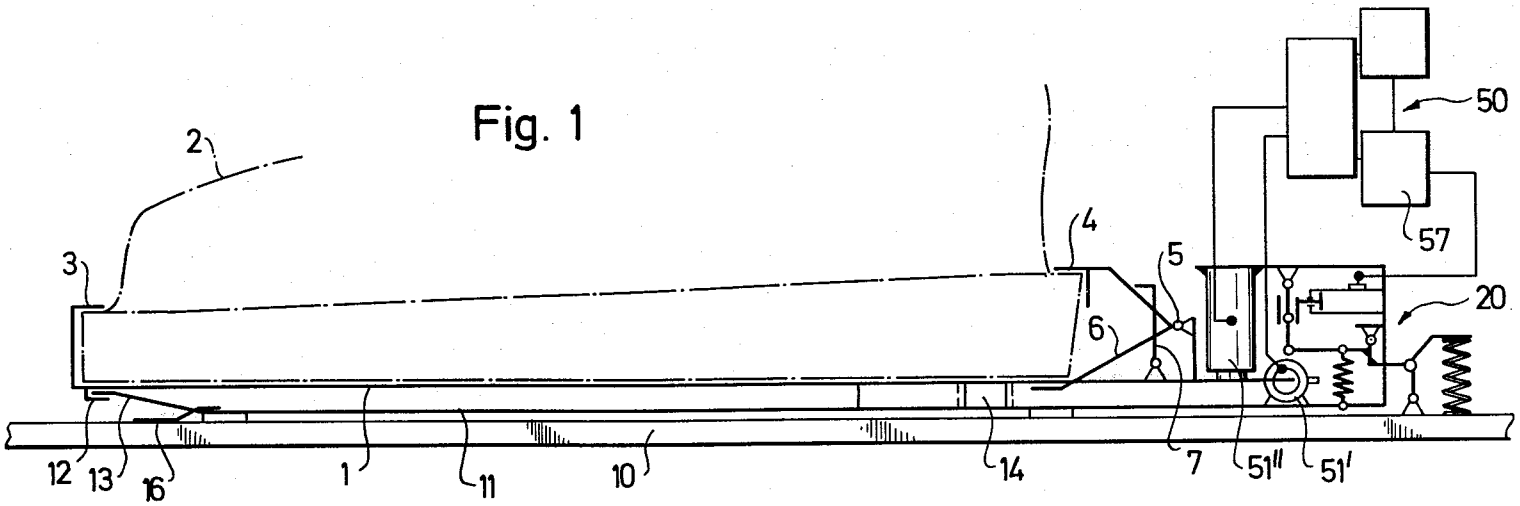
FIG. 1 is a side elevation of an apparatus or ski binding according to the parent application.
Figure 2:
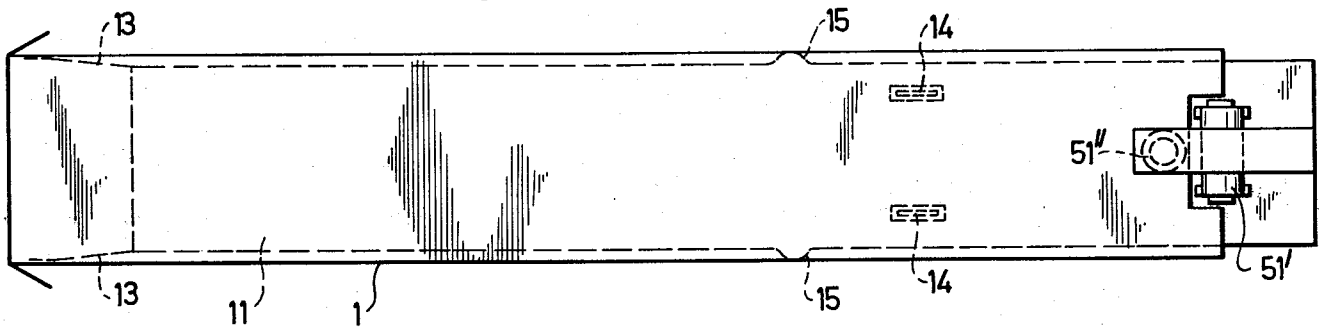
FIG. 2 is a plan view of the sole plate and base plate of the FIG. 1 apparatus, the actual boot-holding members and locking means being omitted for clarity.

The safety ski binding according to the parent application and illustrated in FIGS. 1 and 2 comprises a sole plate 1 on which a ski boot 2 is held in any suitable manner so that it can only be intentionally released. A front or toe sole holder is indicated at 3 and a rear or heel sole holding is indicated at 4. The rear holder is pivotable about a transverse horizontal pivot 5 and fixed to a step-in pedal 6. The sole holder 4 is normally retained in the illustrated locking position by means of a pivotable latch 7. This latch is spring-influenced, and by means of the tip of a ski stick, for example, the latch 7 can be pivoted against the force of the spring towards the right-hand side as viewed in FIG. 1, so that the sole holder 4 is released and the boot 2 can be lifted from the sole plate 1.

On inserting the ski boot in the binding, the heel end of the sole presses on the step-in pedal 6 and swings the rear sole holder 4 to its locking position. The pivotable latch 7 is thereby automatically snapped into engagement. The boot 2 is then held to the sole plate 1 and can only be released intentionally.

An electronic force receiving device generally indicated at 50 is provided adjacent the rear sole holder 4. The sole plate 1 is held to the ski 10 by means of a base plate 11 which is releasable from the ski together with the sole plate 1. At the toe end, the sole plate is provided with a pocket 12 for receiving two swing arms 13 of the base plate 11. The swing arms are so constructed that they can take up tensile and compressive forces in a direction normal to the plane of the ski with comparatively little deformation whereas forces parallel to the plane of the ski are tkaen up with a comparatively large amount of deformation. Near the heel of the boot, a connection between the sole plate 1 and base plate 11 is effected by means of two buffers 14. As in the case of the swing arms at the toe, the buffers can likewise take up tensile and compressive forces normal to the plane of the ski with comparatively little deformation and forces parallel to the plane of the ski with comparatively large amounts of deformation. The sole plate 1 projects laterally beyond the base plate 11 at its two longitudinal sides. Substantially in line with the leg of the skier, a rotary axis between the sole plate and base plate is formed in that the base plate 11 is provided with two lateral cams 15 (see FIG. 2) which make point contact with downwardly flanged longitudinal side walls of the sole plate 1. In this way transverse forces that arise during skiing and which do not lead to twisting of the leg are taken up.

At its rear end, the base plate 11 carries a force receiver 51' of the electronic force receiving device 50. This force receiver 51' is operatively connected to the rear end of the sole plate 1 so that torsional forces exerted on the sole plate are taken up by the force receiver and measured. Any vertically upwardly directed forces exerted on the sole holder 4 through loads exerted on the front are transmitted by the sole plate 1 to a further force receiver 51'' which is also fixed to the base plate 11. The front end of the base plate 11 is releasably held to the surface of the ski by means of a fitting or bracket 16 fixed to the ski. The rear end of the base plate 11 is held to the surface of the ski by means of locking means 20 which become automatically unlocked in the case of danger.

The locking means 20 comprise an articulated lever consisting of two arms 21, 22 and a hinge 23. The arm 21 of the lever is pivoted directly to the base plate 11 whilst the arm 22 is pivoted to a locking lever 24 which, in turn, is pivoted to the base plate 11. The articulated lever is normally held in its elongated condition and is therefore in a state of unstable equilibrium (see FIGS. 1 ane 3).

The locking lever 24 is in the form of a bell crank lever, the arm 22 of the articulated lever being pivoted to one arm of the locking lever. The other arm of the locking lever is cranked and formed with a locking projection 25. This projection is operatively connected to a locking recess of a swing member 26. This swing member, and a helical spring 27 which normally holds the swing member in its locking position, are mounted at the free end of a sufficiently strong leaf spring 31 which is mounted on the surface of the ski 10 for pivotable movement about a vertical axis.

Engaged with that arm of the locking lever 24 which is pivoted to the articulated lever there is a stabilizing spring 28 which is in the form of a helical tension spring having one end suspended on the base plate 11. This stabilising spring serves to bring the articulated lever back to its elongated condition after the base plate 11 has been freed from the ski 10. It also serves to prevent unintentional collapse of the articulated lever. The pivot 23 of the articulated lever constitutes a transmission member which can be actuated by a control member, for example by the core 30 of a moving coil which receives a control signal in the form of an electric impulse from a threshold value switch 57 when the interlocked members 25, 26 are to be unlocked in a case of danger for the purpose of releasing from the ski 10 the base plate 11 and the boot 2 which is connected to the base plate by means of the sole plate 1.

During normal operation, the locking projection 25 of the lever 24 is engaged in the recess of the swing member 26 and is held upwardly as well as to both sides. By reason of the cranked arrangement of the locking projection 25 in relation to the pivot of the locking lever 24, when a control signal for unlocking the boot is delivered, that arm of the locking lever 24 connected to the articulated lever is swung upwardly irrespective of the nature of the load that is applied. Such upward swinging of the arm of the locking lever 24 ensures that the articulated lever collapses further.

Figure 4:
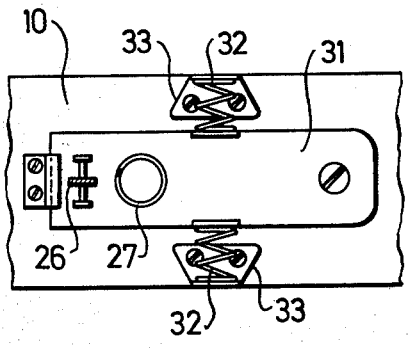
FIG. 4 is a section on the line IV—IV in FIG. 3.

The leaf spring 31 provided in accordance with the present invention is under the influence of two helical compression springs 32 (see FIG. 4) which hold the spring 31 in its normal position on the ski 10 and are themselves supported on the ski by angular stops or brackets 33. The two compression springs 32 are so dimensioned that the transverse forces which arise during normal skiing will not lead to swinging of the leaf spring 31 about its axis. Further, the leaf spring is so strong that upwardly directed forces arising during normal skiing and transmitted through the locking projection 25 will not cause the free end of the leaf spring to be lifted off the ski. This ensures that, prior to safety release of the binding, a limited amount of resilient displacement is possible for the locking projection 25 and hence for the base plate 11 and the sole plate 1 on which the ski boot 2 is held. Only at the end of the elastic path of the spring 31 towards the top as well as towards the sides will the appropriate force receiver 51' or 51'' come into action, whereupon the electronic force receiving device 50 will initiate a releasing operation.

At this time the core 30 of the coil will exert a small force to upset the elongated condition of the articulated lever 21, 22, which can then collapse practically instantaneously under the influence of the releasing force and disengage the locking projection 25 from the swing member 26. Under the influence of the stabilising spring 28, the articulated lever will thereafter immediately resume its elongated condition. Similarly, the leaf spring 31 with swing member 26 and helical spring 27 will return to their normal positions. After this automatic release of the boot 2 from the ski 10, in order that the ski will not become too far separated from the skier, a catching element is provided between the base plate 11 and the ski 10. This catching element is of known construction and has therefore not been illustrated.

Figure 3:
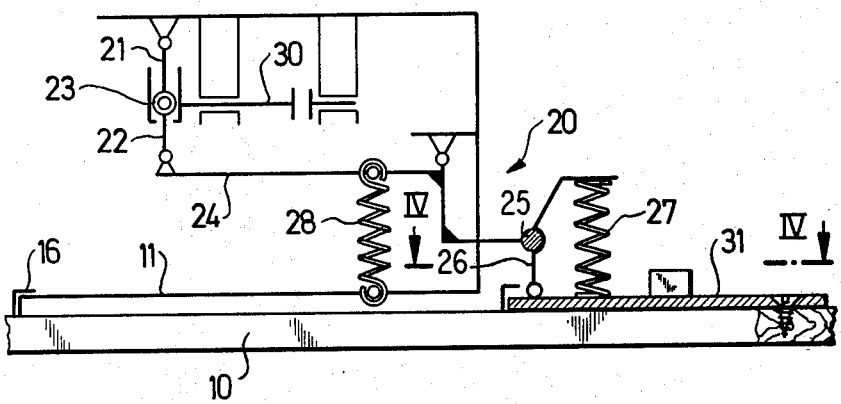
FIG. 3 is a side elevation of the locking means incorporating the features of the present invention.

After safety release, the skier can simply step on the ski 10 with the base plate 11 that is fixed to the boot 2. The toe end of the base plate 11 is led under the fitting, or bracket, 16 and the locking projection 25 of the locking lever 24 at the heel end of the base plate is engaged with the swing member 26 which, for this purpose, can swing to the right as viewed in FIG. 3 against the force of the helical spring 27, so that the apparatus will then again be in an operative condition.

I claim:

1. A safety ski binding for the automatic release of a ski boot from a ski in case of danger to the skier, comprising:

a ski having a surface;

a base plate releasably mounted on said ski;

a ski boot attaching means connected to said base plate for attaching a ski boot to said base plate;

a locking means mountd on said ski for releasably locking said base plate to said ski, said locking means including a resilient base member having lateral edges mountable on said ski to undergo transverse and vertical movements with respect to said ski surface in response to forces exerted on the skier's leg, a locking member fixed to one end of said resilient base member, mounting means fixedly mounting the end of said resilient base member remote from said locking member to said ski, a deformable member fixed to said ski and attached to one of said resilient base member lateral edges for limiting said resilient base member transverse movement to a predetermined amount;

connecting means fixed to said base plate releasably connected to said locking member;

a force evaluting means associated with said connecting means; and an actuating means on said base plate cooperating with said force evaluating and connecting means for causing said connecting means to be released from said locking member when a dangerous amount of force is applied to the skier's leg; and means for limiting said resilient base member vertical movement to a predetermined amount, said predetermined amounts of resilient base member vertical and transverse movement corresponding to forces exerted on the skier's leg which are less than said dangerous amount of force required to cause said connecting means to be released from said locking member.

2. The safety ski binding of claim 1 further including a time evaluating means associated with said force evaluating means and cooperating with said actuating means for controlling the release of said connecting means from said locking member according to the length of time the skier's leg is subject to said dangerous amount of force.

* * * * *